US005816081A

United States Patent [19]

Johnston

[11] Patent Number: 5,816,081

[45] **Date of Patent: *Oct. 6, 1998**

[54] METHODS AND APPARATUS FOR LOCKING PERIPHERAL EQUIPMENT TO A COMPUTER HOUSING

[75] Inventor: John E. Johnston, Redwood City, Calif.

[73] Assignee: Apple Computer, Inc., Cupertino, Calif.

[ * ] Notice: The term of this patent shall not extend beyond the expiration date of Pat. No. 5,810,461.

[21] Appl. No.: 779,666

[22] Filed: Jan. 7, 1997

[51] Int. Cl.[6] ..... E05B 73/00

[52] U.S. Cl. ..... 70/58; 439/942; 361/827; 220/3.8; 220/242; 312/265.6; 312/223.6; 70/164

[58] Field of Search ..... 70/58, 164, 159, 70/160, 161, 162, 168, 18; 174/659, 655; 439/942, 371; 361/826, 827, 829; 312/223.1, 223.2, 223.6, 265.5, 265.6, 263; 248/68.1; 220/3.8, 242, 241

[56] References Cited

U.S. PATENT DOCUMENTS

| | | | |
|---|---|---|---|
| 3,278,066 | 10/1966 | George et al. | 220/241 |
| 4,003,228 | 1/1977 | Lieven et al. | 70/58 |
| 4,850,657 | 7/1989 | Placke et al. | 312/223.6 X |
| 4,898,009 | 2/1990 | Lakoski et al. | 70/168 X |
| 4,985,695 | 1/1991 | Wilkinson et al. | 70/58 X |
| 5,018,052 | 5/1991 | Ammon et al. | 361/724 X |
| 5,142,442 | 8/1992 | Daniels et al. | 361/724 X |
| 5,228,319 | 7/1993 | Holley et al. | 70/58 |
| 5,579,657 | 12/1996 | Makous | 70/58 X |
| 5,601,349 | 2/1997 | Holt | 361/726 X |

*Primary Examiner*—Jose V. Chen
*Assistant Examiner*—Janet M. Wilkens
*Attorney, Agent, or Firm*—Burns, Doane, Swecker & Mathis, L.L.P.

[57] ABSTRACT

A computer includes receptacles for receiving electric cables of peripheral equipment. A gate can be mounted to the housing to extend across the cables and form a gap small enough to prohibit the cable plugs from being separated from the housing. The gate can be locked to the housing by a cable anchoring device which also anchors the housing to a stationary structure. Hence, the computer housing is anchored, and the peripheral equipment is locked to the anchored housing.

6 Claims, 3 Drawing Sheets

METHODS AND APPARATUS FOR LOCKING PERIPHERAL EQUIPMENT TO A COMPUTER HOUSING

BACKGROUND OF THE INVENTION

The invention relates to personal computers and, in particular, to a security mechanism for locking peripheral equipment to a computer housing.

It is conventional to provide a personal computer with peripheral equipment, such as keyboards, modems, monitors, printers, etc., which have electric cables that plug into receptacles provided in the computer housing.

It is also conventional to fixedly anchor the computer housing to a support structure (e.g., desk, wall, etc.) by an anchoring mechanism, such as, for example, a steel anchoring cable which can be locked to the computer housing. That will aid in preventing theft of the computer housing, but will not deter theft of the peripheral equipment.

Although separate anchoring structures could be provided for each piece of peripheral equipment, it would be expensive to provide numerous anchoring structures, and the manipulation of the anchoring structures would be time consuming and inconvenient to the users.

Therefore, it would be desirable to deter the theft of peripheral equipment in a relatively inexpensive and convenient manner.

SUMMARY OF THE INVENTION

The present invention relates to a personal computer comprising a housing which includes at least one plug receptacle adapted to receive a plug of an electric cable of peripheral equipment. A securing member is lockable to the housing for preventing the electric cable from being separated from the housing.

The securing member preferably comprises a gate mountable so as to extend across the electric cable and prevent the plug thereof from being separated from the housing.

The housing preferably includes a lock-receiving structure adapted to receive an external lock that fixedly anchors the housing. A portion of the gate is situated adjacent the lock receiving structure when the gate is in a closed position, wherein the gate is locked to the housing by the external lock.

The invention also relates to a method of securing peripheral equipment to a personal computer. The method comprises plugging an electric cable of peripheral equipment into a receptacle of a computer housing, orienting a securing member on the housing such that the securing member prevents the electric cable from being separated from the housing, and locking the securing member to the housing.

The housing is preferably anchored to a fixed structure by an anchoring element which also locks the securing member to the housing.

BRIEF DESCRIPTION OF THE DRAWING

The objects and advantages of the invention will become apparent from the following detailed description of preferred embodiments thereof in connection with the accompanying drawing in which like numerals designate like elements and in which.

DETAILED DESCRIPTION OF PREFERRED EMBODIMENTS OF THE INVENTION

Figure 1:
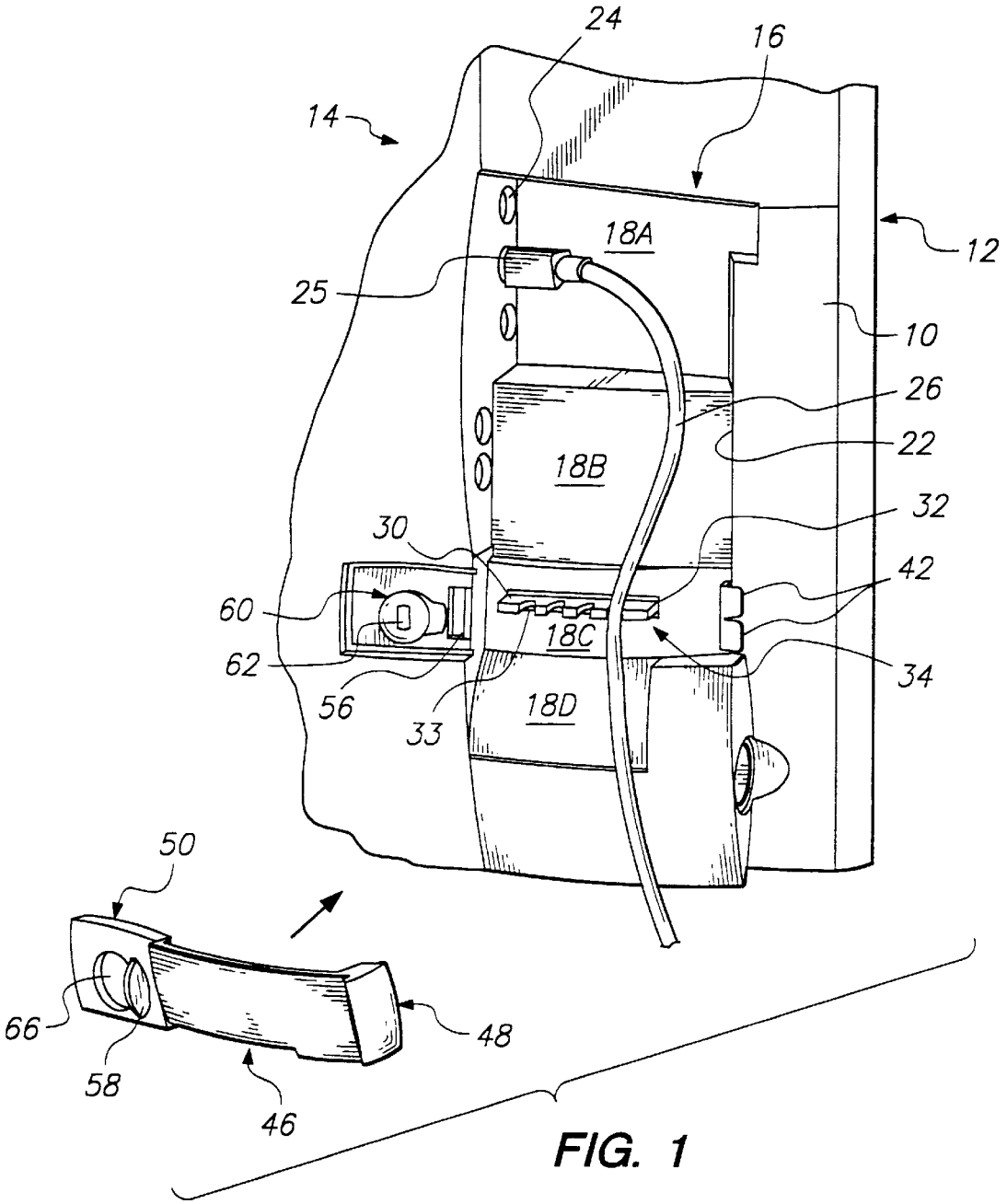
FIG. 1 is an exploded perspective view of a fragmentary portion of a rear wall of a computer housing, with an electric cable of peripheral equipment plugged into the rear wall, and with a gate or cover in the process of being installed onto the rear wall.
Figure 4:
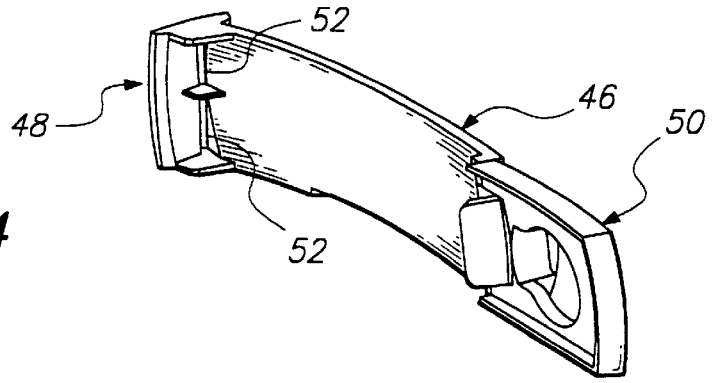
FIG. 4 is a rear perspective view of the gate depicted in FIG. 1.

Depicted in FIG. 1 is an external side of a rear panel 10 of a housing 12 of a personal computer 14. A recess 16 formed in that external side includes a stepped end wall 18 and a pair of side walls 20, 22. The end wall 18 is stepped to form vertically adjacent portions 18A, 18B, 18C and 18D. Situated in the side wall 20 are plug receptacles 24 adapted to receive plugs 25 of electric cables 26 of peripheral equipment such as a keyboard, modem, monitor, printer, etc. (only one such cable being depicted). The recess 16 thus forms an area in which the electric cables are disposed. The bottom portion 18D of the end wall 18 forms an opening through which the electric cable projects.

Figure 6:
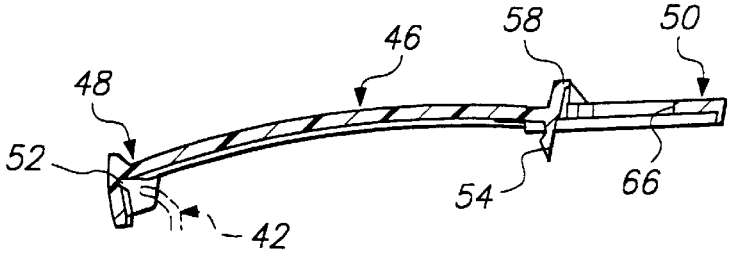
FIG. 6 is a sectional view taken along the line 6—6 in FIG. 5

Situated in the portion 18C of the end wall 18 is a horizontal slit 32 (see FIG. 1) which is adapted to receive a slotted element or comb 34 which is connected, e.g., by friction fit, within the slit 32. The comb 34, which is also shown in FIG. 6, forms a plurality of slots 33 sized to receive the electric cables by friction fit. The comb is preferably formed of an elastic material such as plastic or rubber. By running the cables through the comb, the cables become more organized, and manageable, besides improving the overall appearance of the computer area.

Formed along an edge 40 of one of the side walls 22 of the housing are two fingers 42 which extend in a direction away from the other side wall 20. A securing member in the form of a cover or gate 46 is adapted to be mounted to the fingers 42. The gate 46, which is depicted in FIGS. 1, 2, 4 and 5, includes opposite ends 48, 50. The end 48 constitutes a hinge end, and the other end 50 constitutes a locking end. The hinge end includes a pair of recesses 52 (see FIGS. 4 and 6) adapted to receive respective ones of the fingers 42 to define therewith a hinge enabling the gate to be swung between open and closed positions. The recesses 52 are separated from each other by a flange 55 which is sized to enter a space formed between the fingers 42 in order to guide the gate during its rotation.

Figure 2:
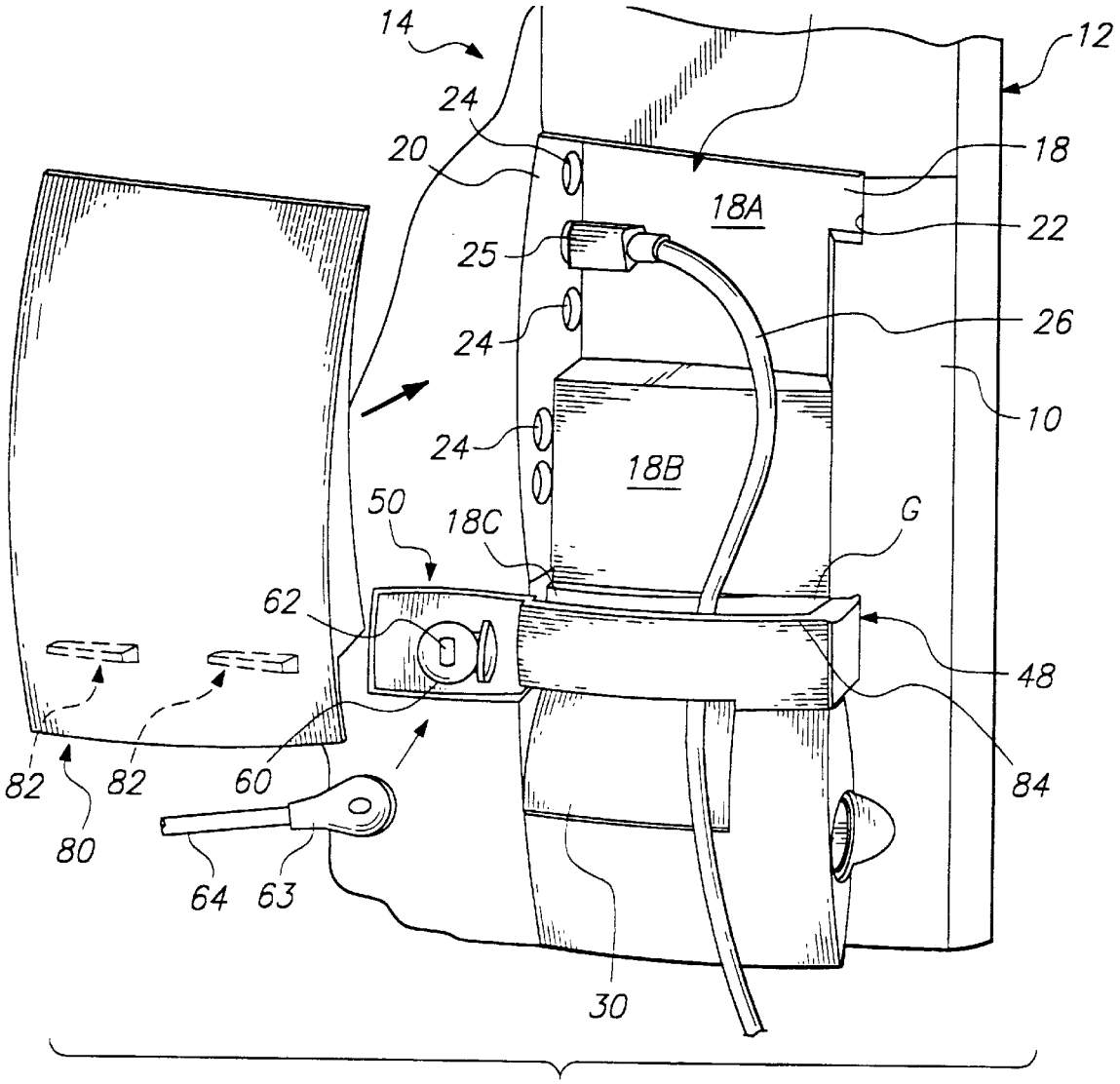
FIG. 2 is a view similar to FIG. 1 depicting the gate in its installed condition, and further depicting a locking cable and a cover in the process of being installed.
Figure 5:
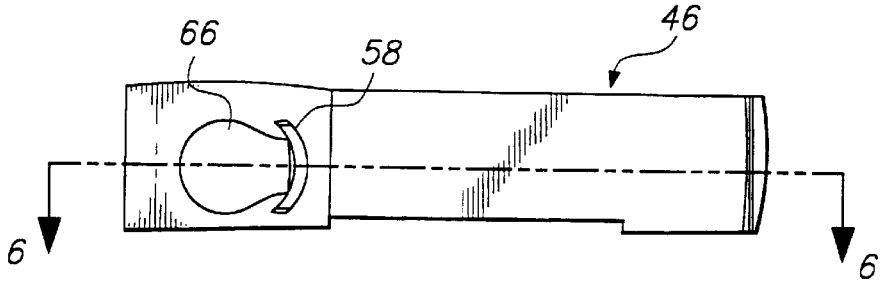
FIG. 5 is a front elevational view of the gate.

In its closed position, the gate extends across a portion of the recess 16 in which the comb 34 is mounted as shown in FIG. 2, the gate thus functioning to cover the comb. The gate 46 thus forms with the portion 18C of the end wall 18 a gap G that is narrower than the plug 25 of the electric cable 26. Thus, with the cable 26 situated between the gate 46 and end wall 18, the cable 26 cannot be separated from the housing 12. If desired, the gate 46 could be configured to lie closely adjacent a front edge 30 of the comb 34 when the gate is in its closed position, to prevent the cable from becoming dislodged from its respective slot 33.

The locking end 50 of the gate includes a flexible latch finger 54 which is adapted to enter a recess 56 formed in the panel 10 when the gate 46 is closed. The latch finger 54 engages behind a shoulder (not shown) disposed in the recess 56 in order to yieldably (e.g. frictionally) retain the gate in a closed position. A rib 58 formed on the gate enables a user to grip the gate to swing it open.

The panel 10 includes a projection 60 having an opening 62 formed therein which is adapted to receive an external locking element 63 of a conventional anchoring cable device 64, such as a Kensington security lock for example, in order to fixedly anchor the computer housing 12 to a stationary structure such as a wall. Basically, the locking element 63 includes a key-actuated T-bar (not shown) which enters the opening 62 of the projection 60 and becomes locked to the projection when rotated by ninety degrees with a special key (not shown).

The locking end 50 of the gate includes a hole 66 large enough to receive the projection 60 but smaller than the locking element 63 of the anchoring device 64. Thus, by locking the locking element 63 to the housing 12 while the gate 46 is closed, the housing 12 is anchored to a support, and simultaneously the gate is locked to the housing.

In that way, not only is the housing secured against theft, but the peripheral equipment is locked to the housing 12 by the closed gate 46. Separation of the peripheral equipment from the housing cannot be accomplished without cutting the respective electric cable, thus deterring such theft.

If desired, a cover extension element 80 can be attached to the gate 46 to overlie the plug receptacles 24 and the upper end of the electric cable and present a neater appearance. The cover extension 80 can be attached to the gate in any suitable way, such as by a snap fit produced by elastic fingers 82 (see FIG. 2) which grip an upper edge 84 of the gate 46.

To utilize the present invention, a user connects the electric cables 26 of peripheral equipment to the computer housing 12 by plugging the plugs 25 into respective receptacles. Intermediate sections of the cables are inserted into respective slots 33 of the comb 34 to present an organized appearance (see FIG. 1).

Then the gate 46 is installed by inserting the hinge fingers 42 into the respective recesses 52, thereby forming a hinge about which the gate can be swung to its closed position (FIG. 2). In the closed position of the gate, the locking element 63 of the cable anchoring device 64 can be connected to the projection 60 of the housing, to anchor the housing 12 to a support and simultaneously lock the gate 46 to the housing 12. Since the gap G formed between the gate 46 and the wall section 18C is narrower than the plugs 25 of the electric cables, the electric cables cannot be separated from the housing 12.

Figure 3:
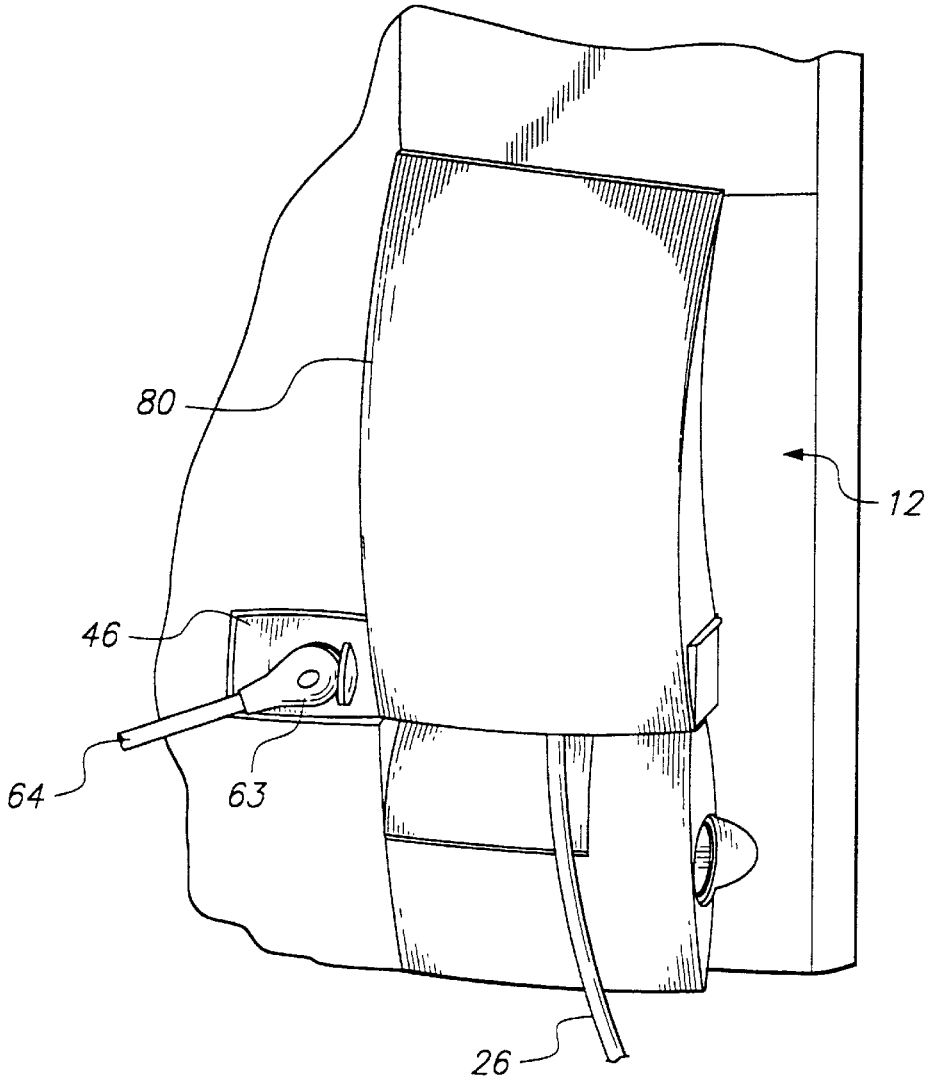
FIG. 3 is a view similar to FIG. 2 after the cover and locking cable have been installed.
Figure 7:
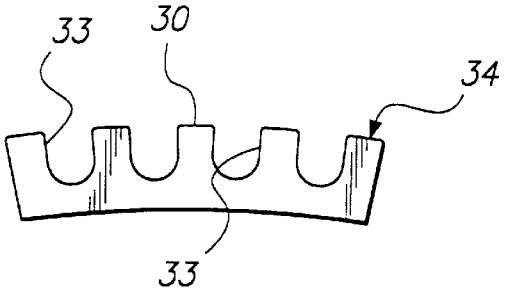
FIG. 7 is a plan view of a comb member depicted in FIG. 1.

If a yet neater appearance is desired, the cover extension 80 can be snapped onto the gate 46 (FIG. 3) to conceal the upper portions of the cables.

It will be appreciated that the gate 46 need not be locked to the housing by a housing-anchoring device. Instead, the gate 46 could be locked to the housing by any suitable lock, and the housing could, or could not, be anchored. The gate 46 need not be mounted by a hinge; any type of mounting, whether swingable or not, could be utilized for the gate.

If the gate-locking feature were not desired, the gate could be employed simply to function as a cover to conceal the comb and as a carrier for the cover extension 80.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A personal computer, comprising:

a housing including at least one plug receptacle adapted to receive a plug of an electric cable of peripheral equipment; and a securing member lockable to the housing for preventing the electric cable from being separated from the housing;

wherein the housing forms an area adapted to receive an intermediate section of the electric cable; the securing member comprising a gate mountable in a closed position on the housing, wherein the gate extends across the area to form therewith a narrower gap through which the plug of the electric cable cannot pass, the gate being lockable to the housing to prevent the gate from being moved out of its closed position; the housing including a lock-receiving structure adapted to receive an external lock that fixedly anchors the housing, a portion of the gate being situated adjacent the lock-receiving structure when the gate is in its closed position, whereby the gate is adapted to be locked to the housing by the external lock; the gate and housing together forming a hinge enabling the gate to swing between its open and closed positions.

2. The personal computer according to claim 1, wherein the gate is removable from the housing.

3. The personal computer according to claim 2, wherein an edge of the gate is removably attached to the housing to form the hinge.

4. The personal computer according to claim 1, wherein the area comprises a recess formed in an exterior side of the housing, the gate being mountable on that exterior side and being spaced from a wall of the recess to form the gap when the gate is closed; the at least one plug receptacle being disposed in another wall of the recess.

5. The personal computer according to claim 1 where in the lock-receiving structure comprises an opening formed in the housing and adapted to receive a locking element of an external anchoring cable.

6. The personal computer according to claim 5, wherein the housing includes a projection in which the opening is formed; the gate including a hole for receiving the projection.

* * * * *